US007464833B2

(12) United States Patent
Goers

(10) Patent No.: US 7,464,833 B2
(45) Date of Patent: Dec. 16, 2008

(54) HOLDING DEVICE FOR SPORT STACKING CUPS

(75) Inventor: John L. Goers, Castle Rock, CO (US)

(73) Assignee: Speedstacks, Inc., Englewood, CO (US)

( * ) Notice: Subject to any disclaimer, the term of this patent is extended or adjusted under 35 U.S.C. 154(b) by 0 days.

(21) Appl. No.: 11/536,903

(22) Filed: Sep. 29, 2006

(65) Prior Publication Data

US 2008/0078779 A1 Apr. 3, 2008

(51) Int. Cl.
*A47F 1/04* (2006.01)

(52) U.S. Cl. ..... 221/312 A; 221/312 R; 221/311; 221/289

(58) Field of Classification Search ..... 221/1–312 C
See application file for complete search history.

(56) References Cited

U.S. PATENT DOCUMENTS

| | | | | |
|---|---|---|---|---|
| 1,592,395 | A | | 7/1926 | Sulzberger |
| 2,062,897 | A | | 12/1936 | Michel et al. |
| 2,667,422 | A | | 1/1954 | Kauffman |
| 2,766,796 | A | | 10/1956 | Tupper |
| 3,228,555 | A | * | 1/1966 | Pinto ..... 211/199 |
| 3,526,316 | A | | 9/1970 | Kalogris |
| 3,649,010 | A | | 3/1972 | Jeffrey et al. |
| 3,785,647 | A | | 1/1974 | Bender |
| 3,795,823 | A | | 3/1974 | Morgan et al. |
| 3,878,675 | A | | 4/1975 | Prociuk |
| 3,920,120 | A | | 11/1975 | Shveda |
| 4,096,966 | A | | 6/1978 | Korshak |
| 4,186,215 | A | | 1/1980 | Buchel |
| 4,220,330 | A | | 9/1980 | Montgomery |
| 4,375,601 | A | | 3/1983 | Van Vliet |
| 4,388,996 | A | | 6/1983 | Panicci |
| 4,392,176 | A | | 7/1983 | Kneip et al. |
| 4,518,266 | A | | 5/1985 | Dawley |
| 4,586,709 | A | * | 5/1986 | Godinet ..... 273/441 |
| 4,700,369 | A | | 10/1987 | Siegal et al. |
| 4,703,930 | A | | 11/1987 | Gilbert |
| 4,818,234 | A | | 4/1989 | Redington et al. |
| 4,877,407 | A | | 10/1989 | du Pont et al. |
| 5,019,950 | A | | 5/1991 | Johnson |
| 5,057,965 | A | | 10/1991 | Wilson |
| 5,284,343 | A | | 2/1994 | Bigornia et al. |

(Continued)

FOREIGN PATENT DOCUMENTS

| | | |
|---|---|---|
| JP | 10086945 | 4/1998 |

OTHER PUBLICATIONS

U.S. Appl. No. 10/215,685, Goers et al.

(Continued)

*Primary Examiner*—Gene Crawford
*Assistant Examiner*—Michael K Collins
(74) *Attorney, Agent, or Firm*—Sheridan Ross P.C.

(57) ABSTRACT

The present invention discloses an improved holding device which allows for retaining, storing and transporting cups used in sport stacking. The invention allows a user to quickly and conveniently store and transport a stack of sport stacking cups using only one hand, by employing a unitary stem incorporating retractable tangs that retain the stack of cups. The tangs may be withdrawn via a spring-loaded plunger, activated by the user's thumb. The invention also includes the use of a shield mechanism, as well as various cup transporting mechanisms.

23 Claims, 5 Drawing Sheets

U.S. PATENT DOCUMENTS

| | | | | |
|---|---|---|---|---|
| 5,325,993 | A * | 7/1994 | Cooper, III | 221/211 |
| 5,480,159 | A | 1/1996 | Alsip | |
| 5,652,975 | A | 8/1997 | Hoskin | |
| 5,702,029 | A * | 12/1997 | Yang | 221/221 |
| 5,838,638 | A | 11/1998 | Tipton et al. | |
| 5,844,861 | A | 12/1998 | Maurer | |
| 5,882,011 | A | 3/1999 | Praria | |
| 5,933,102 | A | 8/1999 | Miller et al. | |
| 5,947,478 | A | 9/1999 | Kwan et al. | |
| 6,181,647 | B1 | 1/2001 | Tipton et al. | |
| 6,229,764 | B1 | 5/2001 | Tongue | |
| 6,328,666 | B1 | 12/2001 | Manory | |
| 6,402,647 | B1 | 6/2002 | Haseltine | |
| 6,471,074 | B2 * | 10/2002 | Coleman et al. | 211/49.1 |
| 6,940,783 | B2 | 9/2005 | Fox et al. | |
| 7,042,806 | B2 | 5/2006 | Fox et al. | |
| 2003/0077360 | A1 | 4/2003 | Ramon | |
| 2006/0021993 | A1 * | 2/2006 | Martin | 221/312 A |
| 2007/0117701 | A1 * | 5/2007 | Goers | 493/143 |

OTHER PUBLICATIONS

U.S. Appl. No. 11/539,794, Goers.

"Welcome to OnlinConversion.com" available at www.onlineconversion.com; printed Feb. 9, 2005; 1 page.

"Welcome to the VCB Kids Speed Stacks Page!" available at www.vcbkids.org; printed Mar. 4, 2005; 3 pages.

www.speedstacks.com; printed on Mar. 3, 2004, 8 pages.

Lee, Norman C., "Control Flash in Extrusion Blow Molding", Plastics Technology, Sep. 2002, 2 pages.

* cited by examiner

HOLDING DEVICE FOR SPORT STACKING CUPS

BACKGROUND

Sport Stacking involves stacking up and down 12 specially designed cups in pre-determined sequences as fast as possible. The sport is often part of school physical education curriculums because of its benefits for students hand eye coordination and reaction time. Specialized cups are required to practice the sport and these cups must be able to be quickly stored and transported by students, teachers and others when a stacking session has ended. The present invention concerns devices which facilitate storage and transportation of these cups.

SUMMARY OF THE PRIOR ART

Two methods for holding and transporting sport stacking cups have been used to date. The first method is to use fabric carry bags that have an opening through which the cups are inserted and removed. Fabric carry bags are inexpensive and adequately support the cups, but can be somewhat awkward for inserting and removing the cups. The second method is an L stem design featuring an enlarged cross section on one end and a removable clip on the other end to retain the cups (see Godinet U.S. Pat. No. 4,586,709 dated May 6, 1986). The device and method have the disadvantage of requiring the user to reach up inside the open end of the last cup in the stack with one hand to insert the stem through the stack and then attach a clip onto the protruding end of the stem with the other hand. This method is slow and cumbersome and requires two hands to accomplish.

SUMMARY OF THE INVENTION

An improved sport stacking cup holding device has been invented that allows the user to quickly and conveniently store and transport a stack of sport stacking cups using only one hand. The device employs a one piece stem design with retractable tangs that retain the stack of cups and are withdrawn via a spring loaded plunger, activated by the users thumb.

DETAILED DESCRIPTION

Before any embodiments of the invention are explained in detail, it is to be understood that the invention is not limited in its application to the details of construction and the arrangement of components set forth in the following description or illustrated in the following drawings. While the following disclosure describes the invention in connection with those embodiments presented, one should understand that the invention is not strictly limited to these embodiments. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Furthermore, one should understand that the drawings are not necessarily to scale, and that in certain instances, the disclosure may not include details which are not necessary for an understanding of the present invention, such as conventional details of fabrication and assembly.

Figure 1:
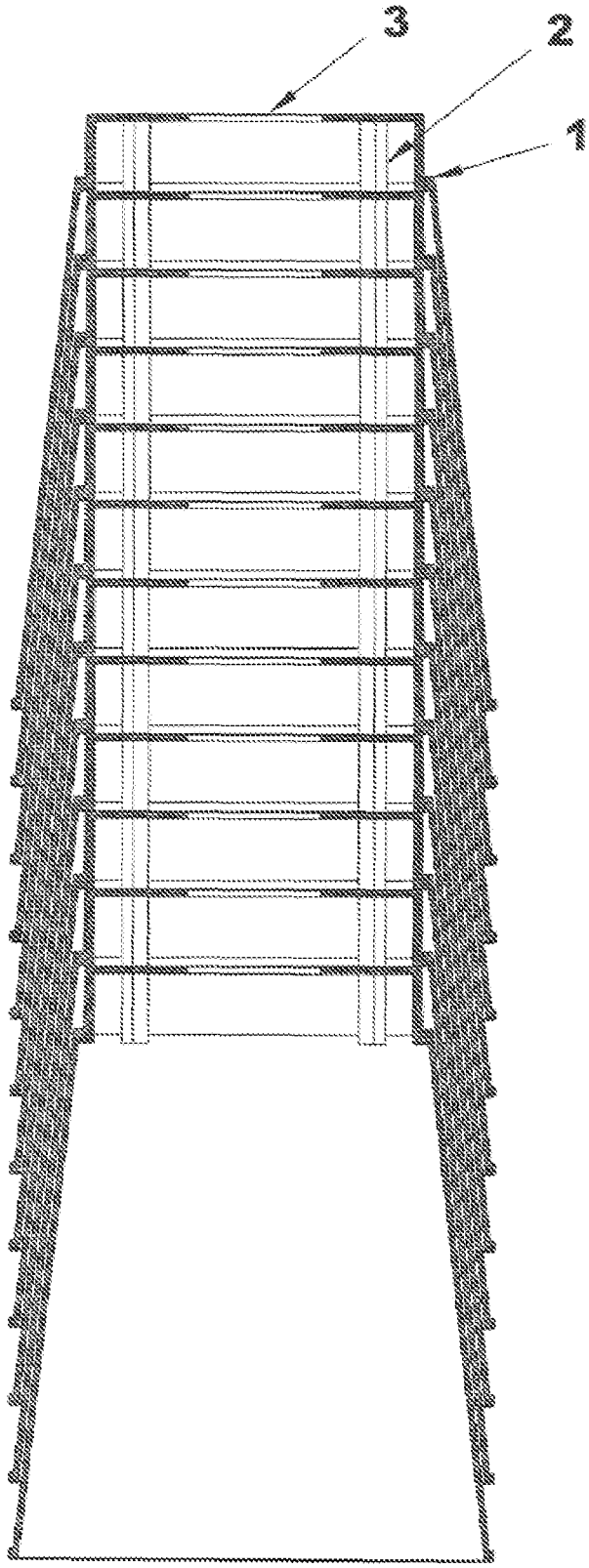
FIG. 1 is a cross sectional view showing 12 sport stacking cups in the stacked position.

FIG. 1 shows a cross section of a set of twelve sport stacking cups 1 stacked in the manner in which they are typically stored. Each cup 1 has molded in standoffs 2 on the inside that keep it separated at a specific distance from the adjoining clip. The top of each cup in the stack rests against the adjoining cups standoffs. Each cup 1 also has a hole in the top 3 which vents air when the cups are stacked. That hole also provides a place for a retention stem to be inserted into the stack.

Figure 2A:
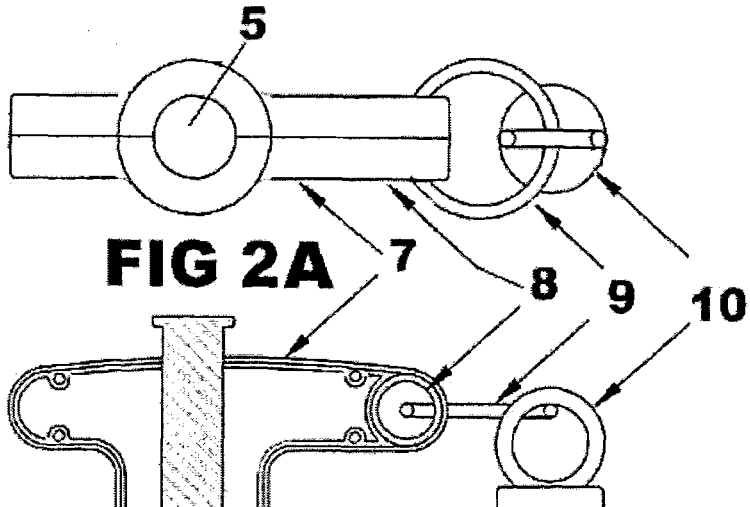
FIG. 2A is a cross sectional view showing the housing and plunger.

FIG. 2A shows the cross section for a stem design that may be used to retain and transport a set of sport stacking cups. The stem is preferably comprised of two housing halves 4 which support and guide the plunger 5. When attached together, the housing halves from a circular cross section and fit inside the hole in the top of the stacking cups. The housing halves include multiple mating features 6 that align and retain the housing halves to each other. These fastening and alignment features are commonly used in molded plastic parts, the design of which are well known to those skilled in the art and include, but are not limited to, features suitable for ultrasonic welding, adhesive bonding, solvent bonding, snap together joint design or removable fasteners. The housing halves are shown as molded plastic parts, but they may also be made from any other material suitable for the purpose. If they are made as molded plastic parts, a preferred plastic material is ABS.

Those of skill in the art will understand that it is possible, and perhaps in some applications preferable, to mold directly into the stem a handle portion 7, which can be used by a cup stacking participant to easily hold a sleeve of cups retained upon the stem. As those in the art will understand, the handle 7 could be made of virtually any suitable material and could be made as part of the stem or separate and apart from the stem housing. It should also be understood that the plunger 5 need not extend through the handle, but could be configured in any number of ways understood by those skilled in the art.

Figure 2B:
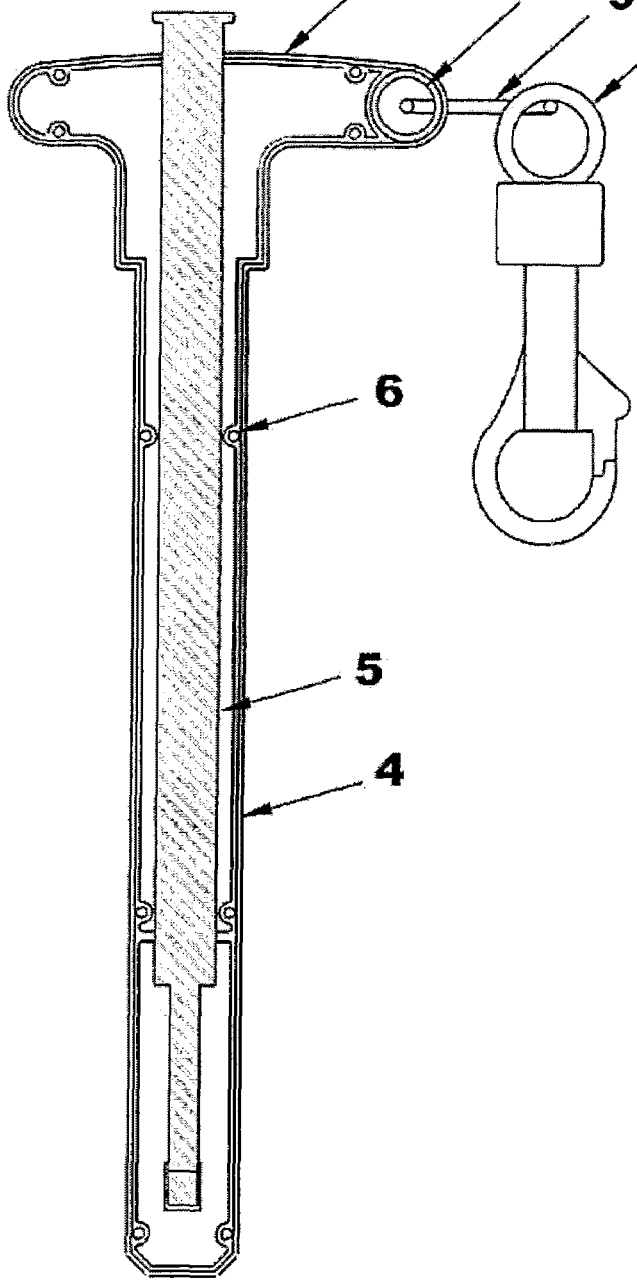
FIG. 2B is a top view of the housing and plunger.

FIG. 2 also shows an embodiment of the handle 7 of the stem 4 which includes a hole feature 8 as part of the handle design. This hole may be used to contain a wire loop 9 and clip assembly 10 which is useful for transporting the stem and cups assembly by attaching the clip to a belt loop, backpack, etc. of the user. The clip may also be used to temporarily store the stem assembly on the backpack or belt loop of the user when it is not being used to hold the cups. Alternately, the handle may be designed without a hole feature and the assembly may be transported by simply grasping the handle. Alternately, the hole may be in the plunger 5 and the wire loop 9 and/or clip 10 may be placed through that hole to support and transport the assembly. Those of skill in the art will understand that modifications to the handle and carrying assembly is well within their skill and any potential implementation thereof is well within the scope of this invention.

Figure 3A:
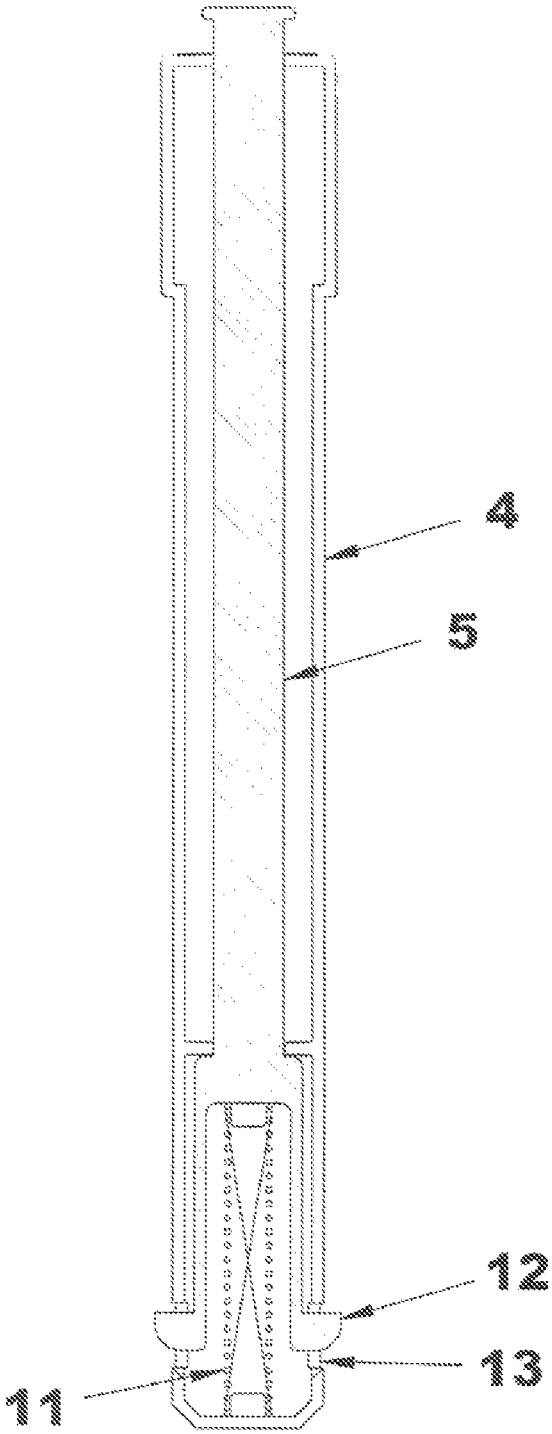
FIG. 3A is a cross section of the plunger mechanism in an extended position.

FIG. 3A shows a partial cross section of the stem taken at 90 degrees to FIG. 2. The plunger 5 is supported and guided by the housing 4 and is kept in the extended position by the spring 11. Tangs 12 on the plunger extend through openings 13 in the housing 4 and protrude beyond the outer surface of the housing 4. As one of skill in the art would understand, the plunger could be engaged in any number of ways known in the art, with the preferred embodiment being just one such arrangement. Also, those skilled in the art would understand that the tangs of the preferred embodiment can be of virtually any appropriate size, shape and geometric configuration. Further, the plunger 5 can be created from any appropriate material.

Figure 3B:
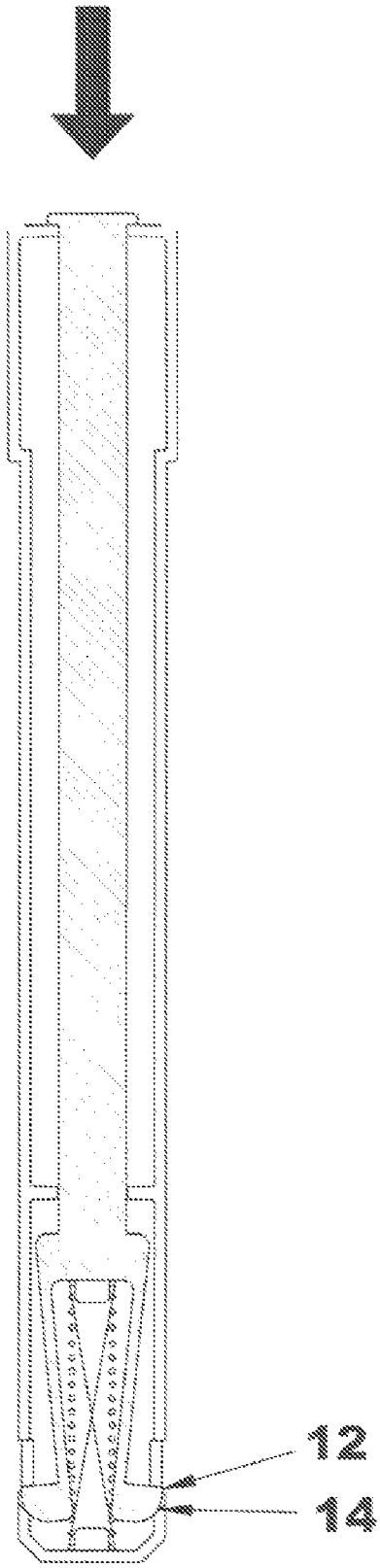
FIG. 3B is a cross section of the plunger mechanism in a retracted position.

FIG. 3B shows the stem with the plunger depressed. When the user depresses the plunger 5, the tangs 12 are preferably forced down and inward by virtue of contacting the bottom of the openings in the housing. The bottom of the opening 14 is preferably slanted to facilitate appropriate movement of the tangs 12 inboard of the housing 4. When the plunger 5is released, the compression spring returns the plunger to the extended position. As the plunger returns to the extend position, the tangs preferably move outward and return to their original position due to the elastic nature of the material used to make the plunger. Delring® is a commonly used material for this purpose.

Figure 4A:
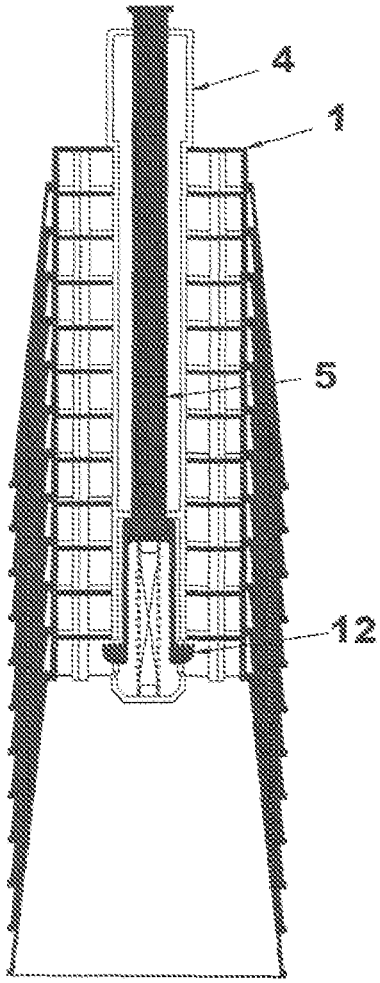
FIG. 4A is a cross sectional view showing the plunger inserted into a stack of cups.
Figure 4B:
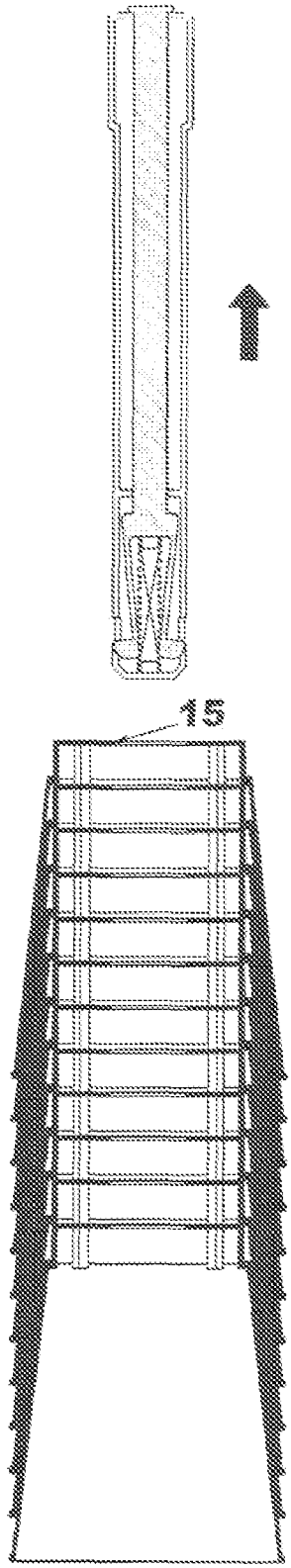
FIG. 4B is a cross sectional view showing the plunger removed from the stack of cups.

FIG. 4A shows the stem 4 inserted into a stack of cups 1. The tangs 12 prevent the stem 4 from being withdrawn from the cups until the plunger 5 is depressed, which in turn retracts the tangs. As the tangs 12 are retracted, the stack of cups 1 is released from the stem assembly and the stem may be withdrawn as shown in FIG. 4B. When the user is ready to store and transport the cups, the user depresses the plunger (which in turn retracts the tangs) and inserts the stem. Note that in the preferred embodiment, the stem may be inserted without first depressing the plunger. In this case the tangs 12 will simply be forced inward by the edges of the holes 15 in the cups.

Figure 5:
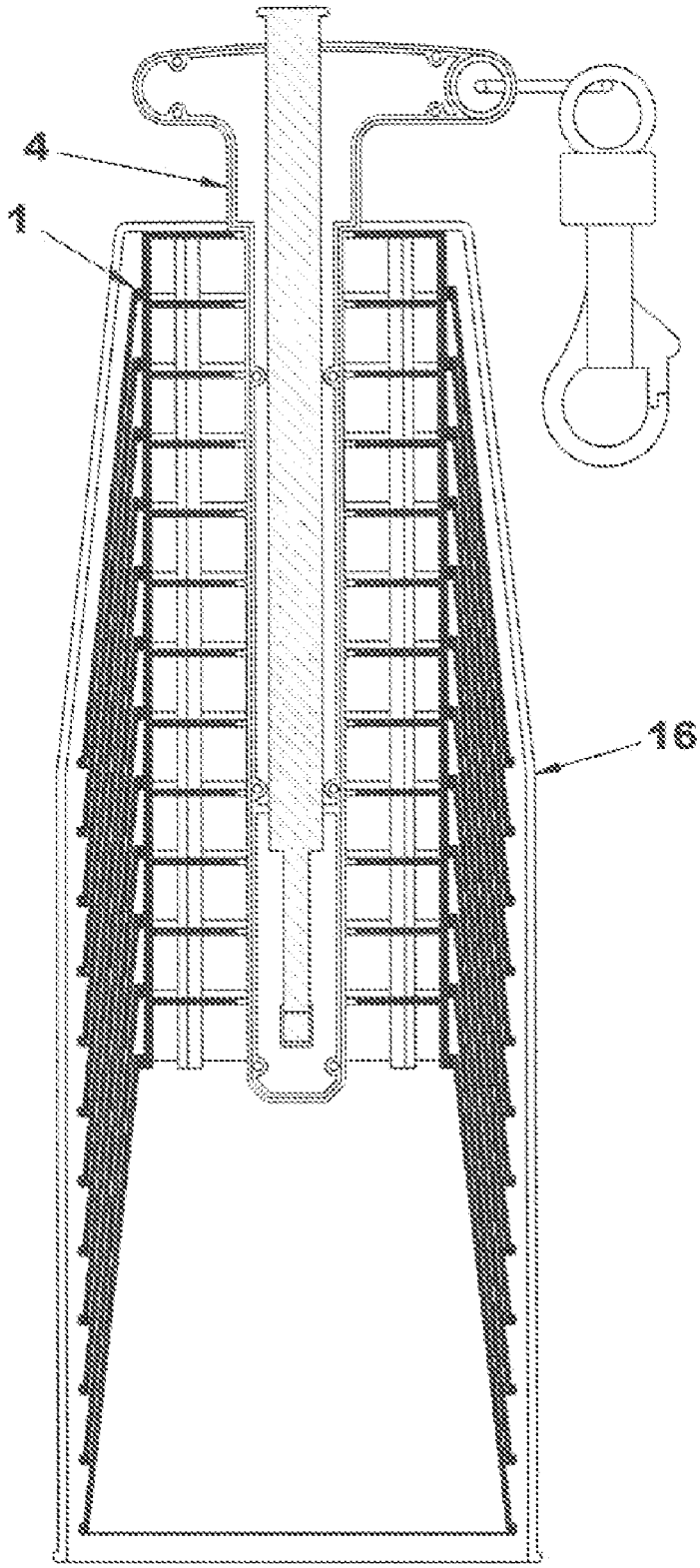
FIG. 5 is a cross section showing an embodiment of the invention employing a shield for the stack of cups.

FIG. 5 shows another embodiment of the design where an additional shield piece 16 is added to the stem 4 to protect the stack of cups 1 from damage during storage and transportation. The shield 16 may be molded as part of the stein 4 housing or may be attached to the housing 4 using any number of common means known to those skilled in the art, including but not limited to, ultrasonic welding, adhesive bonding, solvent bonding, snap together joint design, screw threads or removable fasteners. The shield may protrude beyond the bottom of the stack of cups (as shown in the figure) which provides additional protection of the cups or the shield may be shorter and allow the cups to support the entire assembly.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

The foregoing discussion of the invention has been presented for purposes of illustration and description. The foregoing is not intended to limit the invention to the form or forms disclosed herein. In the foregoing description for example, various features of the invention have been identified. It should be appreciated that these features may be combined together into a single embodiment or in various other combinations as appropriate for the intended end use of the band. The dimensions of the component pieces may also vary, yet still be within the scope of the invention. This method of disclosure is not to be interpreted as reflecting an intention that the claimed invention requires more features than are expressly recited in each claim. Moreover, though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The present invention, in various embodiments, includes components, methods, processes, systems and/or apparatus substantially as depicted and described herein, including various embodiments, subcombiniations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and or reducing cost of implementation. Rather, as the following claims reflect, inventive aspects lie in less than all features of any single foregoing disclosed embodiment. Thus, the following claims are hereby incorporated into this Detailed Description, with each claim standing on its own as a separate preferred embodiment of the invention.

What is claimed is:

1. An improved holding device for sport stacking cups, comprising:

a housing capable of being inserted through a hole in a cup;

a plunger mechanism at least partially housed within the housing and including at least one moveable first member, the at least one movable first member comprising an arm terminating in a second member that deflects inwardly relative to a center axis of the plunger when the second member contacts an edge of an opening in the housing;

wherein the at least one moveable first member is capable of being positioned inside of the housing to release cups therefrom and capable of being positioned outside of the housing to retain cups thereupon.

2. The holding device of claim 1, wherein the plunger mechanism includes at least two moveable members.

3. The holding device of claim 1, wherein a portion of the plunger which is located outside of the housing is capable of being depressed to move the at least one movable first member from outside of the housing to inside of the housing.

4. The holding device of claim 1, wherein the housing has a substantially circular cross section and is substantially elongated.

5. The holding device of claim 1, wherein the plunger mechanism further includes a shaft which includes a depressible portion and a spring.

6. The holding device of claim 5, wherein the at least one movable first member is formed integral with the shaft.

7. The holding device of claim 1, wherein a handle operatively communicates with the housing.

8. The holding device of claim 7, wherein the handle is generally T-shaped.

9. The holding device of claim 7, wherein a clip mechanism is in operative communication with the handle.

10. The holding device of claim 1, further including a shield.

11. The holding device of claim 10, wherein the shield is attached to the housing.

12. A system for securing and transporting sport stacking cups, comprising:

a plurality of nesting sport stacking cups, each cup having a hole;

a stem capable of being inserted through the hole in each of the nested cups;

a plunger mechanism at least partially housed within the stem and including at least one moveable member, the at least one movable member comprising an arm terminating in a tang that deflects inwardly relative to a center axis of the plunger when the tang contacts an edge of an opening in the housing;

wherein the at least one moveable member is capable of being positioned inside of the stem to release the nested cups from the stem and capable of being positioned outside of the stem to retain the nested cups upon the stem.

13. The system of claim 12, wherein the plunger mechanism includes at least two moveable members.

14. The system of claim 12, wherein a portion of the plunger which is located outside of the stem is capable of being depressed to move the at least one movable member from outside of the stem to inside of the stem.

15. The system of claim 12, wherein the stem has a substantially circular cross section.

16. The system of claim 12, wherein the stem is comprised of at least two halves.

17. The system of claim 12, wherein the plunger mechanism further includes a shaft, a spring and a depressible portion.

18. The system of claim 17, wherein the at least one movable member is formed integral with the shaft.

19. The system of claim 12, wherein a handle is attached to the stem.

20. The system of claim 19, wherein the handle is generally T-shaped.

21. The system of claim 20, wherein a clip mechanism is connected to the handle.

22. The system of claim 12, further including a shield.

23. The system of claim 12, wherein the shield is attached to the housing.

* * * * *